US005144920A

United States Patent [19]

Imperial

[11] Patent Number: 5,144,920

[45] Date of Patent: Sep. 8, 1992

[54] AUTOMATIC TIMING GOVERNOR BETWEEN CRANKSHAFT AND CAMSHAFTS, OPERATING BY MEANS OF ACTUATORS ON THE SHAFT CONNECTING CHAIN

[76] Inventor: Renzo Imperial, Via Monti, 30, 22070 Cassina Rizzardi (Como), Italy

[21] Appl. No.: 720,813

[22] PCT Filed: Apr. 14, 1989

[86] PCT No.: PCT/IT89/00026

§ 371 Date: Jul. 11, 1991

§ 102(e) Date: Jul. 11, 1991

[87] PCT Pub. No.: WO90/09513

PCT Pub. Date: Aug. 23, 1990

[30] Foreign Application Priority Data

Feb. 10, 1989 [IT] Italy ..... 19396 A/89

[51] Int. Cl.[5] ..... F01L 1/34

[52] U.S. Cl. ..... 123/90.15; 123/90.17; 123/90.31

[58] Field of Search ..... 123/90.15, 90.17, 90.31

[56] References Cited

U.S. PATENT DOCUMENTS

| | | | |
|---|---|---|---|
| 3,496,918 | 2/1970 | Finlay | 123/90.15 |
| 3,888,217 | 5/1975 | Hisserich | 123/90.15 |
| 4,484,543 | 11/1984 | Maxey | 123/90.15 |
| 4,715,333 | 12/1987 | Oyaizu | 123/90.31 |
| 4,744,338 | 5/1988 | Sapienza, IV | 123/90.15 |
| 4,862,845 | 9/1989 | Butterfield et al. | 123/90.31 |
| 4,872,426 | 10/1989 | Sapienza, IV | 123/90.17 |

FOREIGN PATENT DOCUMENTS

| | | | |
|---|---|---|---|
| 3506106 | 8/1985 | Fed. Rep. of Germany | 123/90.15 |
| 3509094 | 10/1985 | Fed. Rep. of Germany | 123/90.15 |
| 0063338 | 4/1984 | Japan | 123/90.15 |
| 0140807 | 6/1988 | Japan | 123/90.15 |

*Primary Examiner*—E. Rollins Cross
*Assistant Examiner*—Weilun Lo
*Attorney, Agent, or Firm*—Michael J. Striker

[57] ABSTRACT

Governor of the stroke, in internal combustion engines (10) of the stroke between camshafts (13), (14) and crankshaft (12) connected by a continuous belt (20) or chain, to compensate for any effects of wear, assembly errors, stresses due to movement and other factors and, when running speed changes, to set optimum timing values for each speed, comprising actuators (43), (44), operated by an electronic drive unit (50), that determines the variation in length of sections (30), (31) of the belt (20) between the crankshaft (12) and the camshafts (13), (14) and between the latter two, while an automatic belt tightener (21) maintains the tension of the belt (20) constant from one moment to the next.

7 Claims, 2 Drawing Sheets

Figure 1:
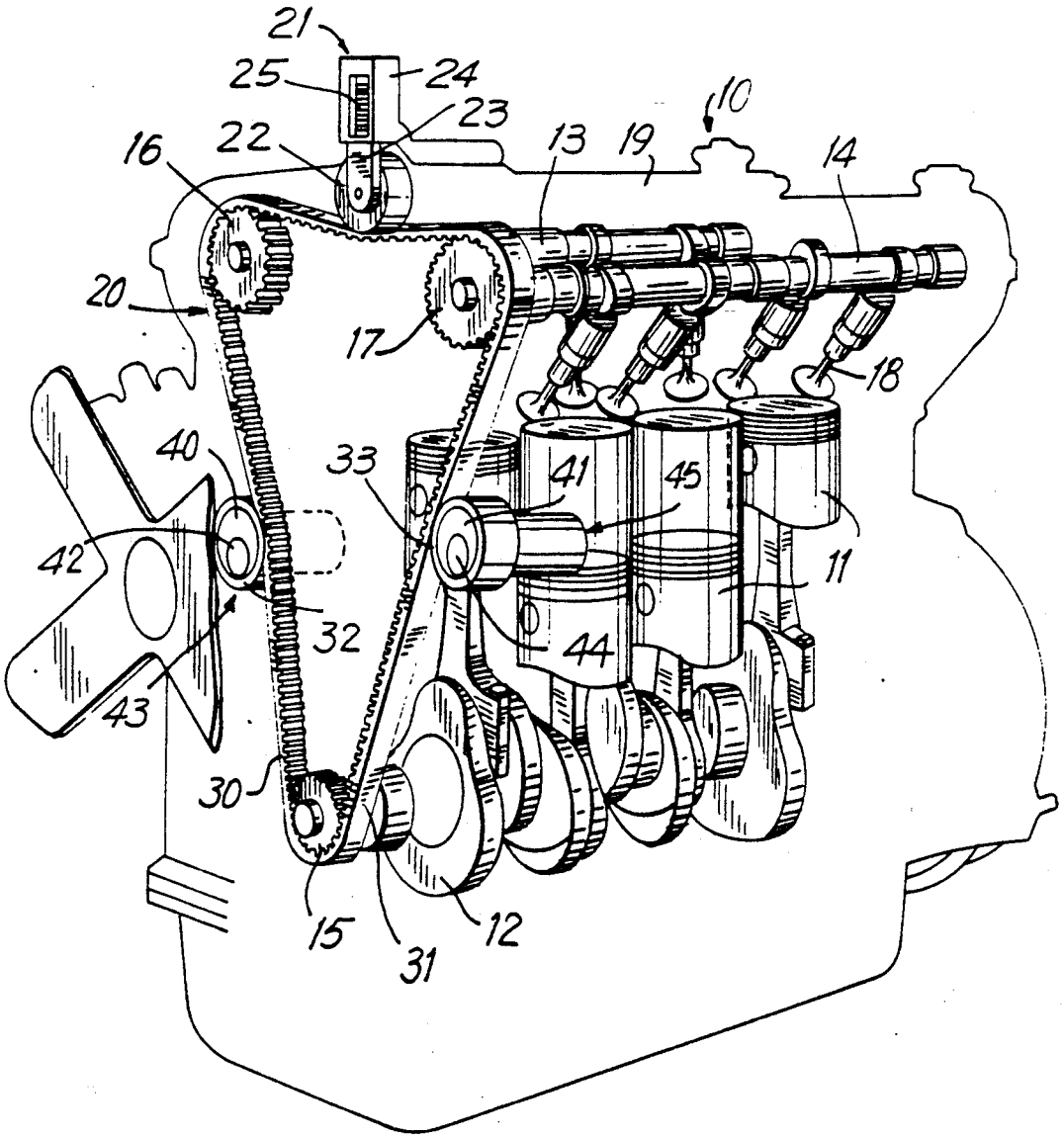

AUTOMATIC TIMING GOVERNOR BETWEEN CRANKSHAFT AND CAMSHAFTS, OPERATING BY MEANS OF ACTUATORS ON THE SHAFT CONNECTING CHAIN

As the title indicates, this invention concerns an automatic governor, for internal combustion engines, that regulates the stroke between the crankshaft and the camshafts by means of actuators placed to operate on the chain connecting said crank and camshafts.

Internal combustion engines, as is known, use fuel that becomes consumed within the mass of active fluid. To transform thermal energy into mechanical energy it is essential to have what are known as crankshafts with pistons sliding in their cylinders, and valves for feeding in the fuel and discharging the products of combustion. These valves are operated by a camshaft according to a combination of factors defining the instants in which said valves open and close in relation to the position of the crankshaft. This combination of factors is expressed in the word "timing".

Timing means that precise stage of the operation when the crankshaft and the camshaft are situated in a radial position, in relation to each other, that will obtain maximum performance from the engine.

Said performance depends on variables, such as:

- the sequence of movements causing the suction valve to rise;
- inertia of the column of flow moving the inlet duct;
- the need to have exhaust pressure fall as low as possible before the return stroke begins;
- possibility of escape for residual gases after the piston has reached its T. D. C.;
- constructional characteristics, etc.

It is further known that optimum timing values differ according to whether engine running speed is high or low.

All the above emphasises the need to have details of timing set in the best possible way and to keep them so set.

In present engines mechanical connection between crankshaft and camshaft is usually made by means of a chain or toothed belt and by pinions or gear wheels.

Connection between crankshaft and camshaft, or shafts, by chains or belts inevitably involves more or less considerable departure from the above mentioned optimum values due to mechanical tolerances of the various parts, and to wear and warping due to heat, stresses, high speeds and changes of regime.

The above invention eliminates these drawbacks and further offers important advantages as will be explained below.

DESCRIPTION OF THE INVENTION

Subject of the invention is a governor, for internal combustion engines, of the stroke between crankshaft and camshafts connected by a belt or continuous chain of some kind, that determines, by means of actuators, the variation in length of sections of chain between the crankshaft and camshafts, or between the latter, without varying the total length of said chain.

It thus becomes possible:

- to compensate for any effects of wear, assembly errors, dimensional variations due to changes of temperature and to the stresses set up by movement;
- to set optimum timing values, as speeds of movement change, for each running speed.

An automatic tightener, acting on a section of chain, keeps constant the tension of said section, from one moment to the next, adjusting the effect of the actuators on the other sections of chain.

Each actuator operates on a section of chain through a cam. The various positions taken up by said cam obviously correspond to a longer or shorter length of said section of chain.

In a preferred type of execution the actuators function by means of an electric motor. Based on data received from appropriate detecting devices an electronic drive unit evaluates, from one moment to the next, the positions of the crankshaft in relation to the camshafts, and puts into operation the actuator motors which then restore, or produce, optimum timing.

Similarly, a program is inserted in an electronic drive unit which, using information received from an appropriate detecting device when engine speeds change, can control the actuators to secure optimum timing for each running speed.

In one type of execution the detectors consist of sensors mounted onto the fixed structure of the engine on the circular trajectories followed by signalling devices, such as permanent magnets for example, fixed at a certain radial point of the crankshaft and camshafts.

The invented governor can be used both on engines with a single camshaft and on those with two or more camshafts, timing of either type of these shafts being possible by mounting an actuator for each one.

There are obvious advantages attached to this invention. Any accidental variations occurring in the positions of camshafts in relation to crankshafts, compared with those scheduled, is automatically adjusted by the electric actuators worked by the electronic drive unit, restoring timing to its optimum condition.

When engine speed is altered the electronic drive unit will automatically determine the variations in timing between the crankshaft and one camshaft and the other, or between the crankshaft and a single camshaft, to secure the best timing for the new speed a program for which was previously put into the drive unit's electronic circuits.

Engine timing is thus automatically adjusted during movement at any speed so as to establish that most effective between crankshaft and camshafts to produce the best performance in power and efficiency.

Characteristics and purposes of the invention will be made still clearer by the following examples of its execution illustrated by diagrammatic figures.

FIG. 1: Perspective view of an engine for motor vehicles with two camshafts, showing the invented device.

Figure 2:
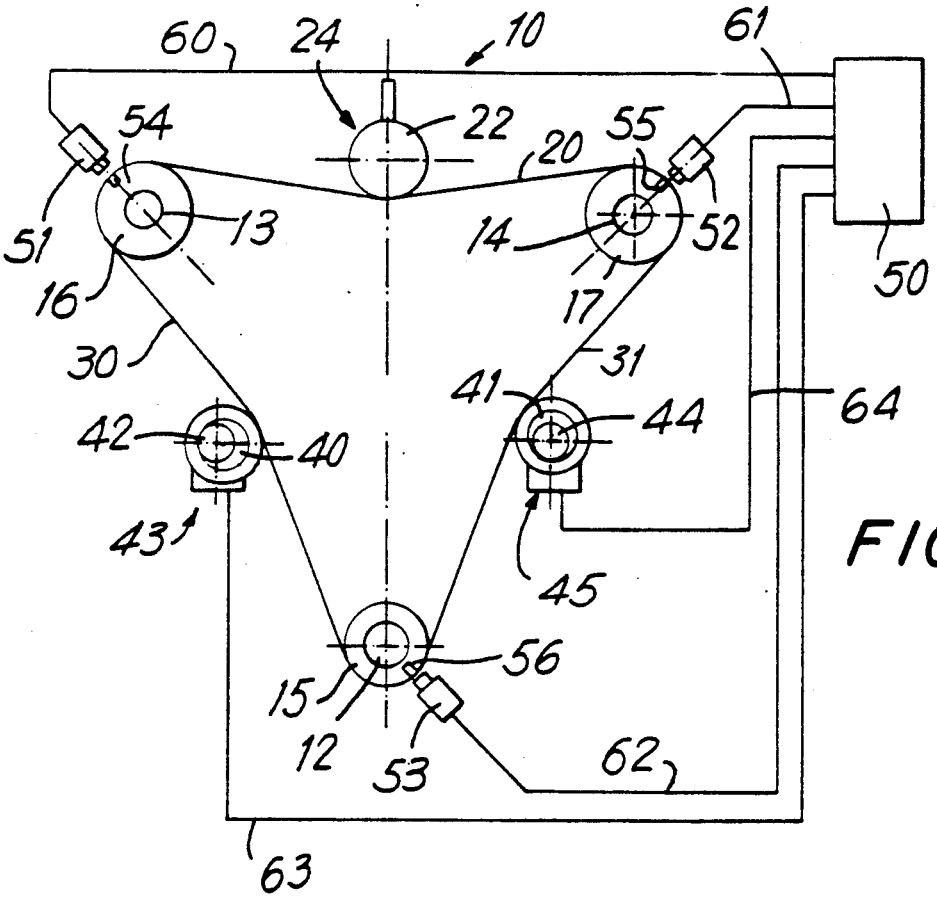

FIG. 2: Diagram of the device shown in FIG. 1.

Figure 3:
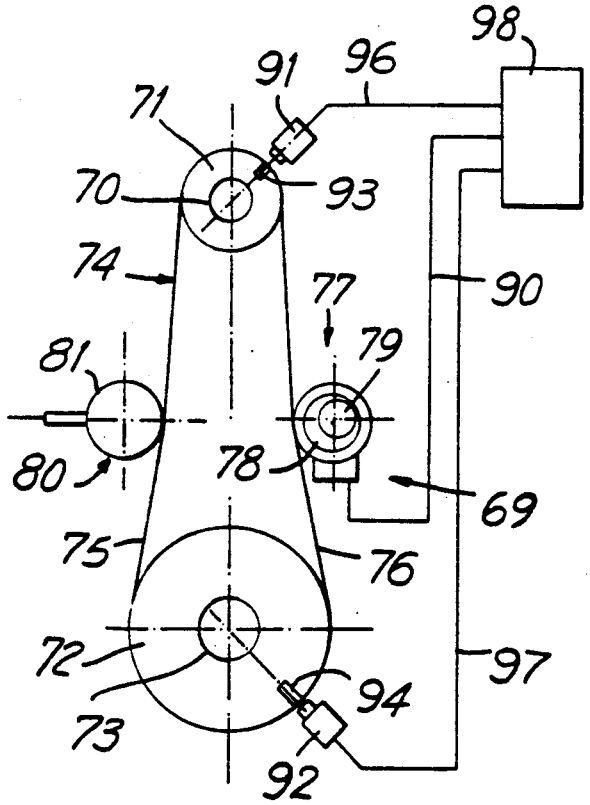

FIG. 3: Diagram of the invented device mounted in an engine with a single camshaft.

The engine 10 with four cylinders 11 has one crankshaft 12 12 and two camshafts 13 and 14, for the valves 18. The pinion gear 15, fixed to the crankshaft, is connected to the gear wheels 16, 17, respectively fixed to camshafts 13, 14 by the toothed belt 20.

An ordinary belt tightener 21 is mounted on a section of belt between gear wheels 16 and 17. Said tightener comprises a roller 22 supported freely by a fork 23 translatable in relation to the support 24 fixed to the structure 19 of the engine.

A spring 25 tends to keep the roller 22 in contact with the belt 20 ensuring constant belt tension which includes adjusting any variations due to wear on the kinematic connections or to any other cause.

On sections 30, 31 of the chain 20, respectively comprised between the pinion gear 15 fixed to the crankshaft and the above gear wheels fixed to the camshafts, cams 40, 41, respectively acting on sections 30 and 31 of the chain 20, through their roller bearings 32, 33, are mounted halfway between said pinion gear and said gear wheels.

Cam 40 is fixed to shaft 42 in the electric actuator 43 while cam 41 is fixed to shaft 44 in the electric actuator 45. Said actuators are fixed to the main structure 19 of the engine 10.

Similarly indicated in diagrammatic FIG. 2 are: the belt 20, its sections 30, 31, the tightener 24 with roller 22, the gear wheels 16, 17 fixed one to one camshaft and the other to the other camshaft respectively, the pinion gear 15 fixed to the crankshaft, and the cams 40, 41 fixed respectively to the actuator shafts.

FIG. 2 also shows the electronic drive unit 50 connected to sensors 51, 52, 53 subjected to action by signalling devices 54, 55, 56 the first two of which are mounted on the gear wheels 16 and 17 fixed to the camshafts, and the third on the pinion gear 15 fixed to the crankshaft. The sensors 51, 52, 53 are connected to the drive unit 50 by wires 60, 61, 62.

The motors of electric actuators 43, 45 are worked by the drive unit 50 to which they are connected by wires 63 and 64 respectively.

The invention can therefore be utilized in various ways to ensure optimum timing at each moment.

Timing between crankshaft and camshafts having been adjusted, the succession of impulses generated by signalling devices 54, 55, 56, the first two mounted on the camshafts and the third on the crankshaft, will indicate to the drive unit if timing is optimum or not and, in any case if it corresponds to the established setting.

If, while the engine is running, timing between camshaft 13, and the gear wheel 16 fixed to it, and crankshaft 12, becomes incorrect for any reason, the electronic drive unit will automatically make cam 40 on actuator 43 rotate so as to extend, or loosen, section 30 of belt 20 until timing between camshaft 13 and crankshaft 12 is restored to optimum value. Alterations in tension of belt 20 due to rotation by the cam are automatically adjusted by the tightening device 24.

Similarly, if timing is incorrect between camshaft 14 and crankshaft 12, indicated to the drive unit 50 by impulses generated by signalling devices 55, 56, respectively on sensors 52, 53, said drive unit's circuit will make actuator 45, and with it cam 41, rotate sufficiently to alter the length of section 31 of the belt and re-establish correct timing in accordance with impulses from signalling devices 55, 56 mounted respectively on sensors 52, 53.

When revolutions change to increase or reduce engine speed, the drive unit is informed by a change of frequency in signals received from impulses emitted by signalling devices 54, 55 on the camshafts and by a similar device on the crankshaft, automatically making either or both cams 40, 41 rotate and alter the length of chain between crankshaft 12, camshaft 13 and camshaft 14 and in this way establish optimum timing for the new speed.

FIG. 3 diagrammatically presents a device, like that already described, mounted on an internal combustion engine 69 with one camshaft 70 only, connected by a gear wheel 71 to a gear wheel 72 fixed to crankshaft 73.

The tightener 80 acts on section 75 of the toothed belt 74 through the roller 81.

The cam 78 acts on section 76 of belt 74, said cam being fixed to shaft 79 through the electric actuator 77 connected by wire 90 to the electronic drive unit 98, to which are also connected sensors 91, 92 respectively situated on the trajectories of signalling devices 93, 94 fixed respectively to the two gear wheels 71 and 72.

The sensors 91 and 92 are connected to the electronic drive unit by their respective wires 96 and 97.

This entire unit operates in the same way as the one illustrated in FIG. 2.

I claim:

1. Governor of timing in internal combustion engines between camshafts and crankshaft connected by a continuous belt or chain, characterized in that said governor determines the variation in length of sections (30), (31) of the belt (20) between the crankshaft (12), (73) and the camshafts (13), (14), (70) and between said camshafts, by means of actuators (43), (45), (77) without altering the total length of said belt, it being thus possible both to compensate for any effects of wear, assembly errors, dimensional variations due to changes in temperature and to stresses created by movement, and, when engine speeds change, to set optimum timing values for each running speed, characterized in that each actuator acts on a section of the belt by means of a cam causing a longer or shorter length of said section to correspond to each angular position of said cam.

2. Governor of the timing in internal combustion engines between canshafts and crankshaft connected by a continuous belt or chain, as in claim 1, characterized in that an automatic tightener (21), (80), acting on a section (75) of the belt (20), (74) maintains tension of said belt unaltered, from one moment to the next, adjusting the effect of the actuators (43), (45), (77) in the other sections (30), (31), (76).

3. Governor of the timing in internal combustion engines between camshafts and crankshaft connected by a continuous belt or chain, as in claim 1, characterized in that the actuators (43), (45), (77) are operated by electric motors.

4. Governor of the timing in internal combustion engines between camshafts and crankshafts connected by a continuous belt or chain as in claim 1, characterized in that, utilizing information received from detecting devices (51–54), (52–55), (53–56), (91–93), an electronic drive unit (50), (98), evaluates, from one moment to the next, the relative positions of the crankshaft (12), (73) and the camshafts (13), (14), (71) and so drives the motors of actuators (43), (45), (77) to restore, or produce, correct timing.

5. Governor of the timing in internal combustion engines between camshafts and crankshafts connected by a continuous belt or chain, as in claim 1, characterized in that, as speed of the engine (10) changes and utilizing information received from detecting devices (51–54), (52–55), (53–56), (91–93), an electronic drive unit (50), (98) so operates the actuators (43), (45), (77) as to produce correct timing for each running speed in accordance with a program put into the circuits of said drive unit (50), (98).

6. Governor of the timing in internal combustion engines between camshafts and crankshafts connected by a continuous belt or chain, as in claim 4, characterized in that the detecting devices consist of sensors (51), (52), (53), (91) mounted on the fixed structure (19) of the engine (10) and situated on the circular trajectories followed by signalling devices (54), (55), (56), (93) such as permanent magnets or some other, fixed both to the crankshaft (12), (73) and to the camshafts (13), (14), (71) at one of their radial points.

7. Governor of the timing in internal combustion engines between camshafts and crankshafts connected by a continuous belt or chain, as in claim 1, characterized in that said governor can be mounted both on engines (69) with one camshaft (70) only and on engines (10) with two or more camshafts (13), (14), enabling the timing between said shafts to be adjusted by mounting an actuator (43), (44) to operate for each of them.

* * * * *